United States Patent [19]

Hummert

[11] 4,337,407

[45] Jun. 29, 1982

[54] INSULATED STRAND BRUSHES

[75] Inventor: George T. Hummert, Oakmont, Pa.

[73] Assignee: Westinghouse Electric Corp., Pittsburgh, Pa.

[21] Appl. No.: 144,815

[22] Filed: Apr. 29, 1980

[51] Int. Cl.[3] ..... H01R 39/36

[52] U.S. Cl. ..... 310/249; 310/220; 310/251; 310/252

[58] Field of Search ..... 310/248, 251, 252, 253, 310/220, 221, 223, 224, 249; 200/164 R

[56] References Cited

U.S. PATENT DOCUMENTS

| | | | |
|---|---|---|---|
| 2,125,027 | 7/1938 | Kasperowski | 310/248 |
| 2,543,301 | 2/1951 | Ramadanoff | 310/248 |
| 3,270,306 | 8/1966 | Burski | 310/248 X |
| 3,555,113 | 1/1971 | Sattler | 525/425 X |

*Primary Examiner*—J. V. Truhe
*Assistant Examiner*—Morris Ginsburg
*Attorney, Agent, or Firm*—F. J. Baehr, Jr.

[57] ABSTRACT

A brush having at least a portion thereof adjacent the trailing end made up of a plurality of individually insulated strands of highly conductive material.

4 Claims, 5 Drawing Figures

FIG. 1
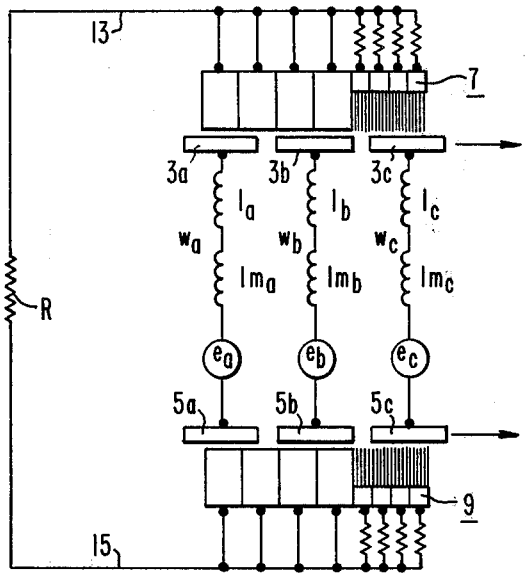
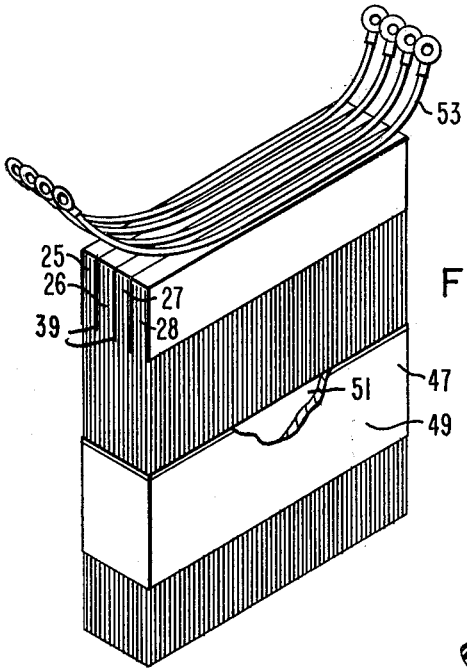
FIG. 5
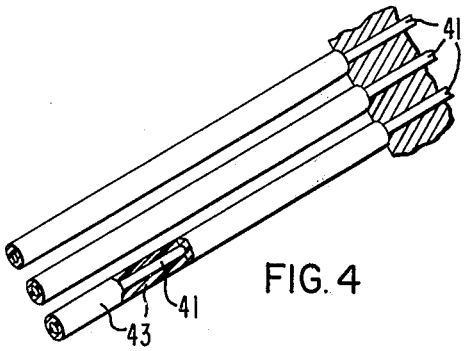
FIG. 4

INSULATED STRAND BRUSHES

The invention described herein was made in the performance of work under a U.S. Government contract with the Department of Defense.

BACKGROUND OF THE INVENTION

This invention relates to an electrical brush and more particularly to a stranded brush having each strand coated with an insulating material.

Electrical brushes are utilized in electrical machinery to transfer current between moving portions of the machine and stationary portions thereof and are normally made of monolithic slabs of carbon or composites of carbon and high conductive metals. In the early stages of development of electrical machinery stranded wire was gathered together in bundles, which resembled a paint brush, and utilized to transfer current between the stationary and moving parts of the electrical machinery, hence, were given the name brushes, a name which continued to be utilized even though the brush changed from a stranded structure to a monolithic structure.

The efficiency of high-current low-voltage DC machinery depends to a large measure on the performance of the brush systems, which transfer current from the rotating to stationary portions of the machine. In order to reduce the resistance losses and improve the overall efficiency of these systems, sintered metallic graphite brushes containing 50 to 75% of silver or copper have replaced conventional carbon or electrographic brushes. These brushes have about one-tenth the resistance of the conventional carbon brush; however, the low resistance in conjunction with bar leakage inductance creates a switching problem at the trailing edge of the brush zone where rotor bars break contact. This problem is known as metal depletion, a condition which occurs due to a high temperature rise at the interface surface where the brush leaves the bar, the temperature rise being sufficient to melt metal from the metal graphite composite brush structure. Depletion occurs first at the trailing edge of the brush zone where the power density reaches a maximum and then moves from the trailing edge toward the undepleted region. Thus, in effect the electrical trailing edge of the brush moves away from the physical trailing edge into the brush face. This continues to occur until power dissipated within the high resistance depletion zone becomes an appreciable fraction of the total power dissipated during the switching interval. At this point the depletion zone stabilizes at a fixed distance from the trailing edge of the brush.

SUMMARY OF THE INVENTION

In general an electrical conductive brush, when made in accordance with this invention, comprises a plurality of strands of highly conductive material, each strand being coated with an insulating material except for a portion adjacent one end thereof. The strands are electrically and physically connected at their uninsulated ends to form at least a portion of the brush.

BRIEF DESCRIPTION OF THE DRAWINGS

The objects and advantages of this invention will become more apparent from reading the following detailed description in conjunction with the accompanying drawings, in which:

FIG. 1 is a schematic diagram of a dynamoelectric machine incorporating this invention;

FIG. 4 is an enlarged partial perspective view of a portion of a brush; and

FIG. 5 is an enlarged partial perspective view of the trailing segment of the brush.

DESCRIPTION OF THE PREFERRED EMBODIMENTS

Figure 2:
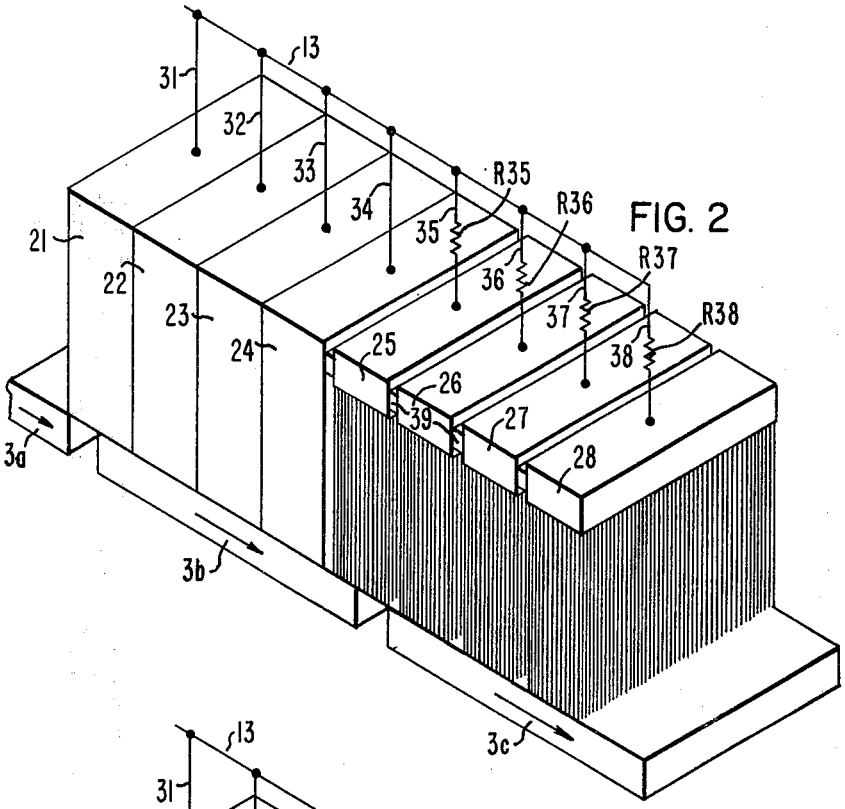
FIG. 2 is a schematic diagram of a brush made in accordance with this invention.

Referring now to the drawings in detail and in particular to FIG. 1 there is shown a schematic diagram of a dynamoelectric machine such as a DC generator, which has a rotor and stator (not shown) each of which have a plurality of windings. The rotor windings are represented by $w_a$, $w_b$, and $w_c$, the inductance of these windings is represented by $\mathbf{1}_a$, $\mathbf{1}_b$, and $\mathbf{1}_c$, respectively, and mutual or coupled inductance of the winding is represented by $\mathbf{1}m_a$, $\mathbf{1}m_b$, and $\mathbf{1}m_c$, respectively. The electromotive force, emf, produced as the rotor windings $w_a$, $w_b$, and $w_c$ pass through an electromagnetic field is represented by $e_a$, $e_b$, and $e_c$, respectively. The windings $w_a$, $w_b$, and $w_c$ have their ends respectively connected to conductor bars $\mathbf{3}_a$, $\mathbf{3}_b$, and $\mathbf{3}_c$ and $\mathbf{5}_a$, $\mathbf{5}_b$, and $\mathbf{5}_c$. Brushes 7 and 9 contact the bars 3 and 5 and supply electrical energy to a load R via the conductors 13 and 15.

As shown in FIG. 2 the brushes 7 and 9 have leading and trailing ends and are made up of a plurality of segments 21, 22, 23, 24, 25, 26, 27, and 28. Each segment being connected to the conductor 13 by a lead wire 31, 32, 33, 34, 35, 36, 37, and 38, respectively. The brush segments 21 through 24 are monolithic slabs of carbon or composite of a high-conductive metal such as silver or copper and graphite. The brush segments 25 through 28 are formed from a plurality of high-conductive metal fibers or strands 41 of copper or silver, coated with a high-temperature insulating material 43 such as polymide insulation as set forth in U.S. Pat. No. 3,555,113.

As shown in FIGS. 4 and 5 the strands are preferably about 5 mils in diameter and are coated with about 0.5 mils of insulation except adjacent one end thereof where the strands 41 are electrically and physically connected together by solder or other means with a conductive channel into a rectangular-shaped bundle containing in the neighborhood of 1,400 individually insulated strands.

The lead wires 35 through 38 each have a resistance R35, R36, R37, and R38, respectively, which decreases as the distance from the trailing segment 28 increases. That is, the resistance R38 is greater than the resistance R35, which may approach the resistance of a highly conductive wire. The brush segments 25 through 28 have an insulating strip 39 of Mylar or other insulating material disposed between adjacent segments so that all current from the individual strands must flow through the associated leads and resistors.

Figure 3:
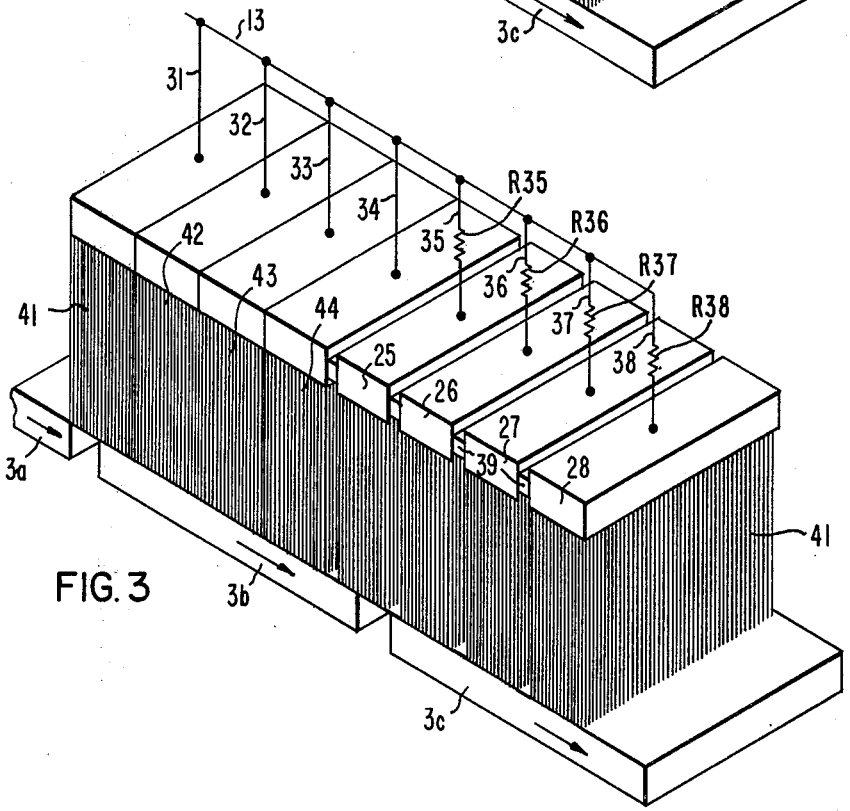
FIG. 3 is a schematic view of a modified brush.

FIG. 3 shows a modified brush wherein the segments 41, 42, 43, and 44 adjacent the leading end of the brush are also formed from insulated strands. However, it should be noted that there is no insulation between the segments and no added resistance in the respective wire leads 31, 32, 33, and 34.

FIG. 5 shows a group of segments 25, 26, 27 and 28 disposed in a guide unit 47 having walls 49, the inner surfaces of which are insulated with polymide film or other insulating material 51. Each lead 53 is shown soldered to the segments 25 through 28, the leads 53 have two ends each of which carries current from the associated brush segment. It is understood that the proper resistance may be supplied by the leads 53 themselves or connected in series therewith.

The operation of the brushes set forth hereinbefore is as follows:

In the prior art as the windings $w_a$, $w_b$, and $w_c$ pass through a field produced by the stator windings, an electromotive forces $e_a$, $e_b$, and $e_c$, respectively, are produced in the windings $w_a$, $w_b$, and $w_c$ and a current flows from the windings through the conductive bars $3_a$, $3_b$, and $3_c$, the brushes 7, the lead 13, and load R, the conductor 15, the brush 9, and conductive bars $5_a$, $5_b$, and $5_c$. Under ideal conditions mutual inductance 1m between adjacent windings in the rotor would be equal to the total self-inductance and the leakage or uncoupled inductance 1 would be zero, however, each winding has a small but significant leakage inductance 1 on the order of 10 to 30% of the mutual or coupled inductance. Thus, each winding $w_a$, $w_b$, and $w_c$ carries uncoupled stored inductive energy as it passes from under a brush zone. As the conductive bars 3 and 5 move out of a brush zone the brush-to-bar contact area diminishes and the resistance increases, which would tend to decrease the current flow, however, the stored uncoupled inductance tends to maintain a constant current by increasing the emf so that as the trailing edge of the brush leaves the conductive bar, power densities reach an extremely high level resulting in a depletion phenomena and the trailing brush bar interface has a temperature rise sufficiently high to melt metal from metal graphite composite brushes utilized in the prior art. Simply grading the brush zone with variable resistance or providing laminated brushes with increased resistance adjacent the trailing end does not work. The depletion area simply moves toward the leading end of such brushes.

However, the brush described hereinbefore eliminates depletion at the trailing end when the brushes have trailing end segments comprising highly conductive strands which are individually coated with a high temperature insulation and the segments are insulated from each other and graduated resistances are disposed in the leads to the trailing segments so that the resistance increases toward the trailing segment. Since the individual strands are insulated, each strand represents significant current resistance so that as the conductive bars progress toward the trailing end of the brush fewer and fewer fibers remain in contact and resistance increases along with the segments resistance spreading the power more evenly over the contacting surface resulting in the elimination of depletion as the trailing end of the brush leaves the conductive bar.

What is claimed is:

1. An electrical conductive brush for a dynamoelectric machine, said brush having a plurality of segments including leading and trailing segments, said trailing segments being insulated from each other and said trailing segments comprising a plurality of individually insulated strands of highly conductive material physically and electrically connected together at one end, said segments each being electrically connected to a lead having resistance disposed therein, said resistance in the lead connected to the leading segment being substantially less than the resistance in the lead connected to the trailing segment, thereby suppressing the energy in an arc formed as the trailing segment breaks contact and preventing melting of the conductive strands.

2. A brush as set forth in claim 1, wherein the resistance in the leads connected to the trailing segments are graduated and decrease in value as the distance from the trailing segment increases.

3. A brush as set forth in claim 1, wherein some of the brush segments are monolithic.

4. A brush as set forth in claim 1, wherein some of the brush segments are silver and graphite formed into a monolithic shape.

* * * * *